US010100776B2

(12) United States Patent
Nishida

(10) Patent No.: US 10,100,776 B2
(45) Date of Patent: Oct. 16, 2018

(54) PREFORMED ARTICLE FOR CYLINDER HEAD, CYLINDER HEAD, AND METHOD FOR MANUFACTURING CYLINDER HEAD

(71) Applicant: Hideyuki Nishida, Shizuoka-ken (JP)

(72) Inventor: Hideyuki Nishida, Shizuoka-ken (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 106 days.

(21) Appl. No.: 14/649,688

(22) PCT Filed: Dec. 6, 2012

(86) PCT No.: PCT/JP2012/081658
§ 371 (c)(1),
(2) Date: Jun. 4, 2015

(87) PCT Pub. No.: WO2014/087519
PCT Pub. Date: Jun. 12, 2014

(65) Prior Publication Data

US 2015/0322884 A1 Nov. 12, 2015

(51) Int. Cl.

| | |
|---|---|
| ***F02B 69/00*** | (2006.01) |
| ***F02F 1/24*** | (2006.01) |
| ***F02F 1/42*** | (2006.01) |
| ***F02B 69/02*** | (2006.01) |

(52) U.S. Cl.
CPC ..... *F02F 1/242* (2013.01); *F02B 69/00* (2013.01); *F02B 69/02* (2013.01); *F02F 1/4235* (2013.01); *Y10T 29/49272* (2015.01)

(58) Field of Classification Search
CPC ..... F02F 1/242; F02F 1/4235; F02B 69/00; F02B 69/02
See application file for complete search history.

(56) References Cited

U.S. PATENT DOCUMENTS 5,086,747 A * 2/1992 Curhan ..... F02M 31/135 123/545
2012/0298074 A1* 11/2012 Watanabe ..... F02B 23/104 123/445

FOREIGN PATENT DOCUMENTS

| | | | |
|---|---|---|---|
| EP | 0309418 A2 | | 3/1989 |
| JP | H09-88612 A | | 3/1997 |
| JP | 11223154 A | * | 8/1999 |
| JP | H11-257089 A | | 9/1999 |
| JP | 2000-220451 A | | 8/2000 |

(Continued)

OTHER PUBLICATIONS

Engines for Biogas (GTZ, 1988, 133 p.), Klaus von Mitzlaff, accessed from http://www.fastonline.org/CD3WD_40/CD3WD/APPRTECH/G36ENE/EN/BS12_8.HTM.*

*Primary Examiner* — Kevin A Lathers
(74) *Attorney, Agent, or Firm* — Hunton Andrews Kurth LLP

(57) ABSTRACT

A preformed article for a cylinder head, includes: a first portion where a first through hole is to be formed from an upper wall portion to a central portion which is a portion, of a bottom wall portion, forming a combustion chamber of an internal combustion engine; and a second portion where a second through hole is to be formed to the central portion from an outer wall portion (for example, the upper wall portion) positioned above an intake port which opens to the central portion. The first portion and the second portion are portions where a cooling water passage is not formed.

2 Claims, 8 Drawing Sheets

(56) References Cited

FOREIGN PATENT DOCUMENTS

| | | | |
|---|---|---|---|
| JP | 2005014170 | A | 1/2005 |
| JP | 2009221988 | A | 10/2009 |

* cited by examiner

PREFORMED ARTICLE FOR CYLINDER HEAD, CYLINDER HEAD, AND METHOD FOR MANUFACTURING CYLINDER HEAD

CROSS-REFERENCE TO RELATED APPLICATION

This is a national phase application based on the PCT International Patent Application No. PCT/JP2012/081658 filed Dec. 6, 2012, the entire contents of which are incorporated herein by reference.

TECHNICAL FIELD

The present invention is related to a preformed article for a cylinder head, cylinder head, and method for manufacturing cylinder head.

BACKGROUND ART

In some cases, a part is communized between a compression ignition type internal combustion engine (for example, diesel engine) and a spark ignition type internal combustion engine (for example, a gasoline engine), and the commonality is improved. Patent Document 1 discloses a direct injection diesel engine having a cylinder head common to a cylinder head of a gasoline engine.

PRIOR ART DOCUMENT

Patent Document

[Patent Document 1] Japanese Unexamined Patent Application Publication No. 11-257089

SUMMARY OF THE INVENTION

Problems to be Solved by the Invention

In many cases, the compression ignition type internal combustion engine is attached with a glow plug in order to ensure ignitability of the fuel. Therefore, in view of the communization of the cylinder head between the compression ignition type internal combustion engine and the spark ignition type internal combustion engine and in view of the improvement in commonality, it is desired that a technique considers attaching the glow plug.

In view of the above circumstances, it is an object of the present invention to provide a preformed article for a cylinder head enabling enhancement of the communization of a cylinder head between internal combustion engines by enabling attachment of a glow plug in a manner suitable for the communization and the improvement in the commonality of the cylinder head between a compression ignition type internal combustion engine and a spark ignition type internal combustion engine.

It is a further object of the present invention to provide a preformed article for a cylinder head common to these internal combustion engines by enabling attachment of a glow plug in a manner suitable for the communization and the improvement in the commonality of the cylinder head between these internal combustion engines, or to provide a preformed article for a cylinder head suitable for the communization of manufacturing process for the molded cylinder head in each internal combustion engine.

It is a further object of the present invention to provide a cylinder head enabling a reduction in the manufacturing cost by the communization of the manufacturing process for the cylinder head between these internal combustion engines by using these preformed articles for these cylinder head.

It is a further object of the present invention to provide a method for manufacturing a cylinder head enabling a reduction in the manufacturing cost by the communization of the manufacturing process for the cylinder head between these internal combustion engines.

Means for Solving the Problems

The present invention is a preformed article for a cylinder head, the preformed article including: a first portion where a first through hole is to be formed from an upper wall portion to a central portion which is a portion, of a bottom wall portion, forming a combustion chamber of an internal combustion engine; and a second portion where a second through hole is to be formed to the central portion from an outer wall portion positioned above an intake port which opens to the central portion.

In the above mentioned preformed article, it may be configured that the first and second portions are portions where a cooling medium passage is not formed.

In the above mentioned preformed article, it may be configured that the second portion is a portion where a third through hole is capable of being further formed and where the intake port is partially formed, the second through hole is a through hole which is to be formed to at least partially overlap the intake port, and the third through hole is a through hole which is formed from the outer wall portion to the intake port and which has a same axis as an axis of the second through hole.

In the above mentioned preformed article, it may be configured that when the first and second through holes are formed, the first through hole is to be formed to be acceptable to a fuel injection valve, and the second through hole is formed to be acceptable to a glow plug, when the first and third through holes are formed, the first through hole is to be formed to be acceptable to an ignition plug, and the third through hole is to be formed to be acceptable to another fuel injection valve different from the fuel injection valve.

According to another aspect of the present invention, there is provided a cylinder head manufactured by using the preformed article for the cylinder head, wherein the first through hole is formed to be acceptable to a fuel injection valve, the second through hole is formed to be acceptable to a glow plug.

According to another aspect of the present invention, there is provided a cylinder head manufactured by using the preformed article for the cylinder head, wherein the first through hole is formed to be acceptable to an ignition plug, the third through hole is formed to be acceptable to a fuel injection valve.

According to another further aspect, there is provided a method for manufacturing a cylinder head by using a preformed article for the cylinder head, the preformed article for the cylinder head including: a first portion where a first through hole is to be formed from an upper wall portion to a central portion which is a portion, of a bottom wall portion, forming a combustion chamber of an internal combustion engine; and a second portion where a second through hole is to be formed to the central portion from an outer wall portion positioned above an intake port which opens to the central portion, the method comprising: a first step of forming, in the preformed article for the cylinder head, a first through hole to be acceptable to a fuel injection valve, and a second through hole to be acceptable to a glow plug; and a second step of forming, in the preformed article for the cylinder head, the first through hole to be acceptable to an ignition plug, and the third through hole to be acceptable to another fuel injection valve different from the fuel injection valve, wherein the first step and the second step are selectively performed.

In the above mentioned method for manufacturing the cylinder head, it may be configured that the outer wall portion is positioned above an intake port which opens to the central portion, the second portion is a portion where a third through hole is capable of being further formed and where the intake port is partially formed, the second through hole is a through hole which is to be formed to at least partially overlap the intake port, and the third through hole is a through hole which is formed from the outer wall portion to the intake port and which has a same axis as an axis of the second through hole.

In the above mentioned method for manufacturing the cylinder head, it may be configured that the preformed article for the cylinder head includes a first preformed article for the cylinder head and a second preformed article for the cylinder head, the first preformed article for the cylinder head includes the first portion and the second portion, the second preformed article for the cylinder head includes: a same first portion as the first portion; and a third portion where a third through hole is to be formed, the third portion is a portion where an intake port is partially formed, and the third through hole is a through hole which is formed from the outer wall portion to the intake port and which has a same axis as an axis of the second through hole.

Effects of the Invention

According to the present invention, it is possible to enhance communization of a cylinder head between internal combustion engines by enabling attachment of a glow plug in a manner suitable for the communization and the improvement in the commonality of the cylinder head between a compression ignition type internal combustion engine and a spark ignition type internal combustion engine.

According to the present invention, it is further possible to obtain a preformed article for a cylinder head common to these internal combustion engines by enabling attachment of a glow plug in a manner suitable for the communization and the improvement in the commonality of the cylinder head between these internal combustion engines, or to obtain a preformed article for a cylinder head suitable for the communization of manufacturing process for the molded cylinder head in each internal combustion engine.

According to the present invention, it is further possible to obtain a cylinder head enabling a reduction in the manufacturing cost by the communization of the manufacturing process for the cylinder head between these internal combustion engines by using these preformed articles for these cylinder head.

According to the present invention, it is further possible to obtain a method for manufacturing a cylinder head enabling a reduction in the manufacturing cost by the communization of the manufacturing process for the cylinder head between these internal combustion engines.

MODES FOR CARRYING OUT THE INVENTION

Embodiments according to the present invention will be described with reference to the drawings.

First Embodiment

Figure 1A:
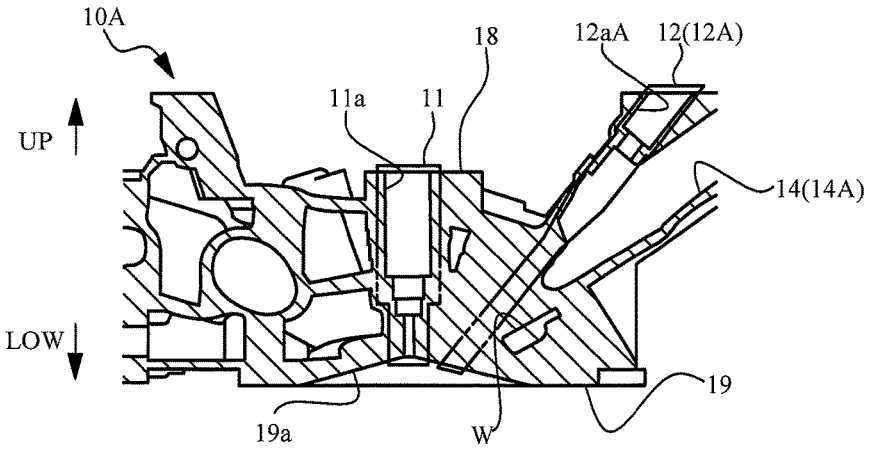
FIG. 1A is a sectional view of a preformed article for a cylinder head according to a first embodiment.
Figure 1B:
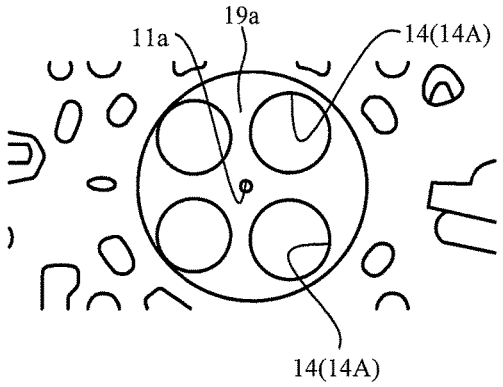
FIG. 1B is a bottom plan view of the preformed article for the cylinder head.

FIG. 1A and FIG. 1B are views of a preformed article for a cylinder head (hereinafter, referred to as preformed article) 10A. FIG. 1A is a sectional view of the preformed article 10A, and FIG. 1B is a bottom plan view of the preformed article 10A. Additionally, as for the vertical direction, as illustrated in FIG. 1A, it is assumed that the vertical direction is perpendicular to the bottom surface and that the bottom surface is positioned at the lowermost position in the vertical direction.

The preformed article 10A includes a portion 11 which is a first portion, and a portion 12 which is a second portion. The portion 11 is a portion where a through hole 15 to be described later is formed. The through hole 15 is specifically a through hole 15A or a through hole 15B to be described later. The portion 11 is specifically a portion including a prepared hole portion 11*a* where the through hole 15 is formed. The prepared hole portion 11*a* is a first prepared hole portion, and is a prepared hole portion common to the through holes 15A and 15B which are formed beforehand in order to form the through hole 15. Specifically, the prepared hole portion 11*a* is a prepared hole portion formed from an upper wall portion 18 to a central portion 19*a* which is a portion, of a bottom wall portion 19, forming a combustion chamber of an internal combustion engine. The central portion 19*a* has a pent roof shape.

The portion 12 is a portion where a through hole 16 to be described later is to be formed. The portion 12 is specifically a portion 12A, and the portion 12A is a portion including the prepared hole portion 12*a*A where the through hole 16 is to be formed. Specifically, the prepared hole portion 12*a*A is a second prepared hole portion and is a prepared hole portion which is formed beforehand in order to form the through hole 16. Specifically, the prepared hole portion 12*a*A is a prepared hole portion formed to an intake port 14 from an outer wall portion (the upper wall portion 18 in this case) positioned above the intake port 14 opening to the central portion 19*a*. The outer wall portion may be, for example, a side wall portion.

The intake port 14 is specifically an intake port 14A which is an intake port common to cylinder heads 1A and 2A to be described later. Specifically, for example, a siamese port which branches into plural portions (two in this case) on the way to the central portion 19*a* and which opens thereto is applicable to the intake port 14.

The portion 12A is a portion where the intake port 14 is partly formed. The portion 12A is a portion where a through hole 17 to be described later can be further formed. Therefore, the prepared hole portion 12*a*A is a prepared hole portion common to the through holes 16 and 17 where the through hole 16 or the through hole 17 is to be formed. The portions 11 and 12A are portions where a cooling water passage W which is a cooling medium passage is not formed.

Figure 2A:
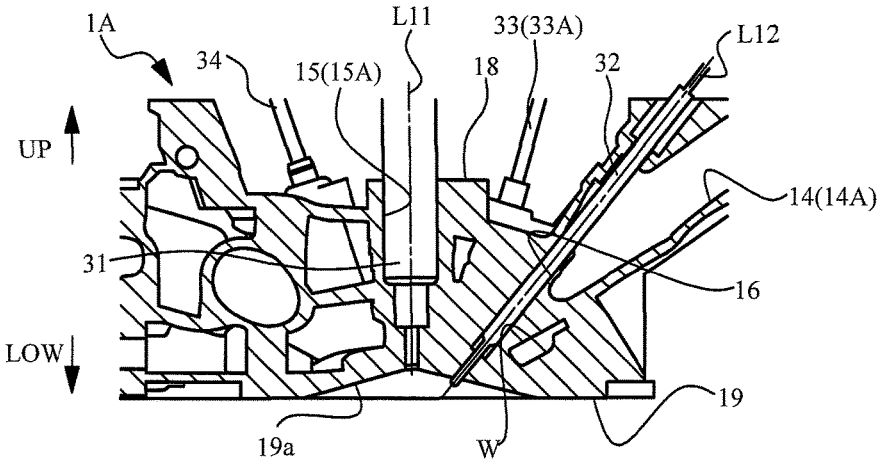
FIG. 2A is a sectional view of a first cylinder head in the first embodiment.
Figure 2B:
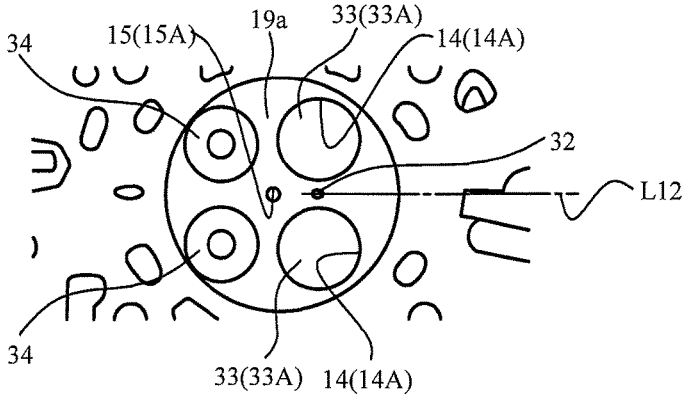
FIG. 2B is a bottom plan view of the cylinder head.

FIG. 2A and FIG. 2B are views of the cylinder head. FIG. 2A is a sectional view of the cylinder head 1A, and FIG. 2B is a bottom view of the cylinder head 1A. FIG. 2A and FIG. 2B illustrate the cylinder head 1A in the state where a fuel injection valve 31, a glow plug 32, intake valves 33, and exhaust valves 34 are provided. The intake valve 33 is specifically an intake valve 33A corresponding to the intake port 14A. Additionally, the intake port 14 in the cylinder head 1A may be an intake port which is the intake port 14 which is predeterminedly processed in the preformed article 10A. This also applies to the cylinder head 2A to be described later.

The cylinder head 1A is a first cylinder head in the present embodiment and is manufactured by using the preformed article 10A. The cylinder head 1A is a cylinder head of the compression ignition type internal combustion engine.

The through hole 15 is a first through hole and is a through hole formed from the upper wall portion 18 to the central portion 19*a*. The through hole 15 is specifically the through hole 15A, and the through hole 15A is formed to be acceptable to the fuel injection valve 31. Therefore, in the cylinder head 1A, the fuel injection valve 31 is provided in the through hole 15A. The fuel injection valve 31 is a fuel injection valve for the compression ignition type internal combustion engine. The through hole 16 is a second through hole, and is a through hole formed from the above mentioned outer wall portion to the central portion 19*a*. The through hole 16 specifically is formed to be acceptable to the glow plug 32. Therefore, in the cylinder head 1A, the glow plug 32 is provided in the through hole 16. The through hole 16 is formed to at least partially overlap the intake port 14.

An axis L12 of the through hole 16 is set as follows. That is, it is set to extend in the intake and exhaust direction (the direction perpendicular to the cylinder arrangement direction of the internal combustion engine) when viewed in the direction perpendicular to the bottom wall surface, as illustrated in FIG. 2B. The through hole 16 is set to open to the central portion of the intermediate portion between the intake ports 14 in the central portion 19*a*. Therefore, the through hole 16 opens to the central portion of the intermediate portion.

Figure 3A:
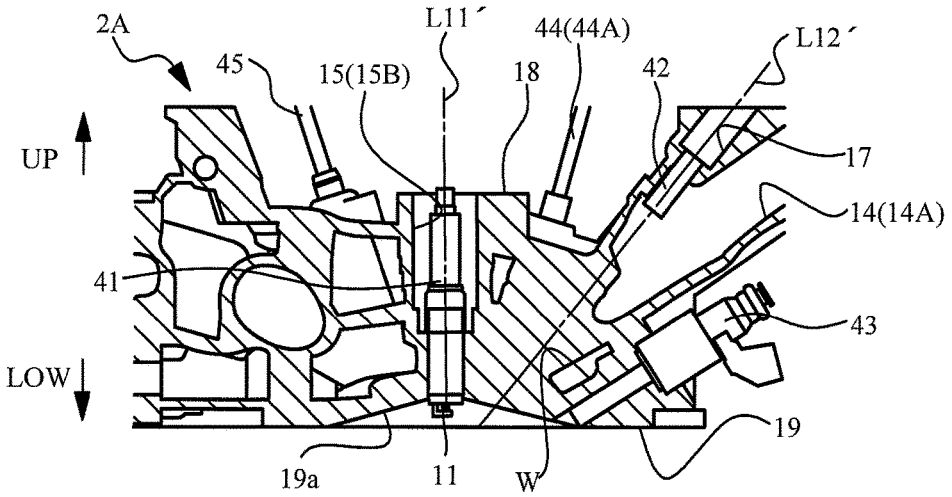
FIG. 3A is a sectional view of a second cylinder head in the first embodiment.
Figure 3B:
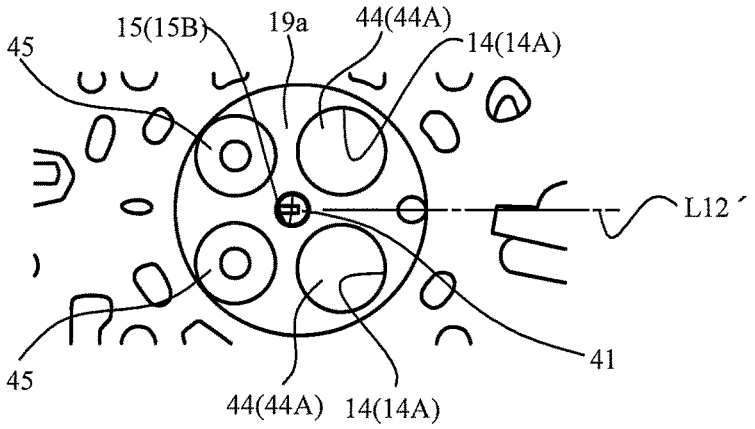
FIG. 3B is a bottom plan view of the cylinder head.

FIG. 3A and FIG. 3B are views of the cylinder head 2A. FIG. 3A is a sectional view of the cylinder head 2A, and FIG. 3B is a bottom plan view of the cylinder head 2A. FIG. 3A and FIG. 3B illustrate the cylinder head 2A in the state where an ignition plug 41, a fuel injection valve 42, a fuel injection valve 43, and intake valves 44, and exhaust valves 45 are provided. The intake valve 44 is an intake valve 44A corresponding to the intake port 14A. The intake valve 44A may be the same as the intake valve 33A. Likewise, the exhaust valve 45 may be the same as the exhaust valve 34.

The cylinder head 2A is a second cylinder head in the present embodiment, and is manufactured by using the preformed article 10A. The cylinder head 2A is a cylinder head for a spark ignition type internal combustion engine, and is more specifically a cylinder head for a spark ignition type internal combustion engine with a turbocharger.

Like the cylinder head 1A, the through hole 15 is a through hole formed from the upper wall portion 18 to the central portion 19*a*. On the other hand, the through hole 15 is specifically the through hole 15B, and the through hole 15B is formed to be acceptable to the ignition plug 41. Therefore, in the cylinder head 2A, the ignition plug 41 is provided in the through hole 15B. The through hole 15B is a through hole having an axis L11' which is the same as an axis L11 of the through hole 15A. Being "the same" includes a case where they differ from each other within a manufacturing error range. To be "the same" also includes a case where they differ from each other within a range where the present invention can have effects. This also applies to the following description.

The through hole 17 is a through hole, and is a through hole formed the above mentioned outer wall portion to the intake port 14. Further, the through hole 17 is a through hole having an axis L12' which is the same as an axis L12 of the through hole 16. The through hole 17 specifically is formed to be acceptable to the fuel injection valve 42. Therefore, in the cylinder head 2A, the fuel injection valve 42 is provided in the through hole 17. The fuel injection valve 42 is a fuel injection valve for the spark ignition type internal combustion engine which injects fuel into the intake port 14. Additionally, the fuel injection valve 43 is a fuel injection valve for the spark ignition type internal combustion engine which injects fuel directly into the combustion chamber of the internal combustion engine.

As for the fuel injection valve 43, the preformed article 10A further includes a portion where a through hole which is to be formed to the central portion 19*a* from the outer wall portion (the side wall portion in this case) positioned under the intake port 14. The portion is a portion where the cooling water passage W is not formed, and the through hole is to be formed to be acceptable to the fuel injection valve 43. The portion is a prepared hole portion where the through hole is to be formed, and may include a portion where an end portion is formed on the way to the central portion 19*a*.

As for formation of the through holes 15A and 15B, in the prepared hole portion 11*a*, a portion which needs processing to provide each corresponding component (the fuel injection valve 31 and the ignition plug 41) is smaller than each of the through holes 15A and 15B. The prepared hole portion 11*a* can be formed such that the portion which does not need processing to provide each corresponding component does not interfere with each corresponding component. On the other hand, the prepared hole portion 12*a*A is a part of the through hole 16, so that the through hole 16 is formed in the prepared hole portion 12*a*A.

It is said that the prepared hole portions 11*a* and 12*a*A are as follows. That is, the prepared hole portion 11*a* may not always open to the central portion 19*a*. Thus, the prepared hole portion 11*a* may be a prepared hole portion which has an end portion formed on the way to the central portion 19*a*. Likewise, the prepared hole portion 12*a*A may be a prepared hole portion which has an end portion formed on the way to the intake port 14. This also applies to a prepared hole portion 12*a*B and a prepared hole portion 13*a* to be described later.

It is said that each of the through holes 15A, 15B, 16, and 17 and each of the prepared hole portions (the prepared hole portions 11*a* and 12*a*A in this case) are as follows. That is, the corresponding prepared hole portion (the prepared hole portion 11*a* or the prepared hole portion 12*a*A in this case) is at least partially each of the through holes 15A, 15B, 16, and 17 as it is, so that each of the through holes 15A, 15B, 16, and 17 may be formed in the corresponding prepared hole portion. Further, the corresponding prepared hole portion (the prepared hole portion 11*a* or the prepared hole portion 12*a*A in this case) may be a portion where at least any one of the corresponding through holes (at least any one of the through holes 15A and 15B, or at least any one of the through holes 16 and 17) is to be at least partially formed.

The cylinder head 1A is manufactured through the process P11 which will be described later and which is a first step in the present embodiment. Further, the cylinder head 2A is manufactured through the process P12 which will be described later and which is a second step in the present embodiment. The process P11 is a process in which the through hole 15 is formed in the preformed article 10A to be acceptable to the fuel injection valve 31 (namely, the through hole 15A is formed) and the through hole 16 is formed to be acceptable to the glow plug 32. The process P12 is a process in which the through hole 15 is formed in the preformed article 10A to be acceptable to the ignition plug 41 (namely, the through hole 15B is formed) and the through hole 17 is formed to be acceptable to the fuel injection valve 42.

The cylinder heads 1A and 2A are manufactured by selectively performing the process P11 or P12. The manufacturing method for the cylinder head (hereinafter referred to as manufacturing method M1) which includes these processes P11 and P12 and which selectively performs the process P11 or P12 is specifically achieved in the processing process which is the manufacturing process after the molding.

Next, the effects of the present embodiment will be described. The preformed article 10A is configured to include the portion 11, so that the fuel injection valve 31 or the ignition plug 41 can be selectively attached. Further, the preformed article 10A is configured to include the portion 12A, so that the glow plug 32 or the fuel injection valve 42 can be selectively attached.

Therefore, the preformed article 10A enables the selective attachment of the fuel injection valve 31 or the ignition plug 41, and further enables the attachment of the glow plug 32 in a manner suitable for the communization and the improvement in the commonality of the cylinder head between the compression ignition type internal combustion engine and the spark ignition type internal combustion engine. This can result in enhancement of the commonality of the cylinder head between these internal combustion engines.

In the preformed article 10A, specifically, the portions 11 and 12A are configured to be a portion where the cooling water passage W is not formed. Such a configured preformed article 10A enables the selective and suitable attachment of the fuel injection valve 31 or the ignition plug 41 and of the glow plug 32 and the fuel injection valve 42.

In the preformed article 10A, specifically, the portion 12A is configured to a portion where the through hole 17 can be further formed and the intake port 14 is partially formed. Further, in the preformed article 10A, the through hole 16 is configured to be a through hole which is to be formed to at least partially overlap the intake port 14. Such a configured preformed article 10A enables the selective and suitable attachment of the glow plug 32 and the fuel injection valve 42.

In the preformed article 10A, specifically, as for the formation of the through holes 15 and 16, the through hole 15 is configured to be formed to be acceptable to the fuel injection valve 31, and the second through hole 16 is configured to be formed to be acceptable to the glow plug 32. Further, in the preformed article 10A, as for the formation of the through holes 15 and 17, the through hole 15 is configured to be formed to be acceptable to the ignition plug 41, and the through hole 17 is configured to be formed to be acceptable to the fuel injection valve 42. Such a configured preformed article 10A is preferred as a preformed article common to the compression ignition type internal combustion engine and the spark ignition type internal combustion engine.

The cylinder head 1A is manufactured by using the preformed article 10A. Therefore, the cylinder head 1A can reduce the manufacturing cost by the communization of the manufacturing process for the cylinder head between the compression ignition type internal combustion engine and the spark ignition type internal combustion engine. Further, in the cylinder head 1A, the through hole 15 is formed to be acceptable to the fuel injection valve 31, and the through hole 16 is formed to be acceptable to the glow plug 32. It is thus possible to obtain a cylinder head for the compression ignition type internal combustion engine on the basis of the cylinder head 1A.

The cylinder head 2A is manufactured by using the preformed article 10A. Therefore, the cylinder head 2A can reduce the manufacturing cost by the communization of the manufacturing process for the cylinder head between the compression ignition type internal combustion engine and the spark ignition type internal combustion engine. Further, in the cylinder head 2A, the through hole 15 is formed to be acceptable to the ignition plug 41, and the through hole 17 is formed to be acceptable to the fuel injection valve 42. It is thus possible to obtain a cylinder head for the spark ignition type internal combustion engine on the basis of the cylinder head 2A.

The cylinder heads 1A and 2A are manufactured by using the common preformed article 10A. Therefore, even in the casting process besides the processing process after the molding, the cylinder heads 1A and 2A can reduce the manufacturing cost by the communization of the manufacturing process for the cylinder head between the spark ignition type internal combustion engine and the compression ignition type internal combustion engine.

The cylinder head 1A specifically is configured such that the axis L12 of the through hole 16 extends in the intake and exhaust direction when viewed in the direction perpendicular to the bottom wall surface. Therefore, in the cylinder head 1A, the through hole 16 can avoid limiting the process, so the opening portion of the intake port 14 can be set large in the central portion 19*a*. This can result in the improvement in fuel consumption based on the improvement in output and the reduction in pumping loss in the compression ignition type internal combustion engine. Additionally, the preformed article 10A in which the axis L12 of the through hole 16 is set in the same manner has the same effects.

In the combustion chamber of the compression ignition type internal combustion engine, the distance between the fuel injection valve 31 and the glow plug 32 influences as follows. That is, too long distance degrades the ignitability of the glow plug 32. Too short distance causes the glow plug 32 to block the diffusion of the spray, which tends to generate smoke in the high load.

On the other hand, the cylinder head 1A is configured such that the intake port 14 is set to open to two positions of the central portion 19*a*, and such that the through hole 16 is set to open to the central portion between the intermediate portion of each intake port 14 in the central portion 19*a*. Such a configured cylinder head 1A can set the suitable distance between the fuel injection valve 31 and the glow plug 32 in the combustion chamber of the compression ignition type internal combustion engine. The preformed article 10A in which the intake port 14 is set to open to two positions of the central portion 19*a* and in which the through hole 16 is set in the same manner has the same effects. This applies to a cylinder head 1B and a preformed article 10B corresponding to the cylinder head 1B to be described later in the second embodiment.

The cylinder head 1A specifically is configured such that the central portion 19*a* has a pent roof shape. Therefore, the cylinder head 1A can suppress generation of smoke in the high load in the compression ignition type internal combustion engine, as will be described later.

Figure 4A:
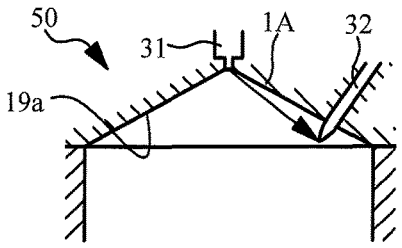
FIG. 4A illustrates an example of a compression ignition type internal combustion engine using the first cylinder head in the first embodiment.
Figure 4B:
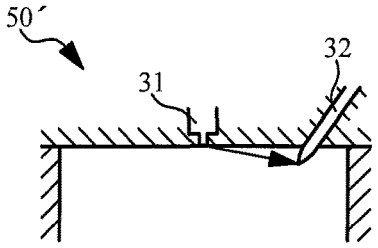
FIG. 4B illustrates an example of a general compression ignition type internal combustion engine.

FIG. 4A and FIG. 4B are views of an example of a compression ignition type internal combustion engine. FIG. 4A illustrates an internal combustion engine 50 as an example of the compression ignition type internal combustion engine using the cylinder head 1A. FIG. 4B illustrates an internal combustion engine 50' as an example of a typical compression ignition type internal combustion engine. In the combustion chambers of the internal combustion engines 50 and 50', the distance between the fuel injection valve 31 and the glow plug 32 is set to be suitable. On the other hand, the internal combustion engine 50 enables the fuel spray to contact the glow plug 32 by an angle close to the vertical, as compared with the internal combustion engine 50'.

Therefore, the internal combustion engine 50 can ensure the ignitability while reducing the exposure degree of the glow plug 32 from the combustion chamber, as compared to the internal combustion engine 50'. Thus, in the internal combustion engine 50, the cylinder head 1A can ensure the ignitability while reducing the exposure degree of the glow plug 32 from the combustion chamber. As a result, the cylinder head 1A can suppress generation of smoke in the high load in the internal combustion engine 50. Additionally, the preformed article 10A in which the central portion 19*a* has a pent roof shape has the same effects.

The manufacturing method M1 includes the processes P11 and P12 and selectively performs the process P11 or P12. Thus, the manufacturing method M1 can reduce the manufacturing cost by the communization of the manufacturing process for the cylinder head between the compression ignition type internal combustion engine and the spark ignition type internal combustion engine. The manufacturing method M1 can reduce the manufacturing cost, specifically, in the processing process after the molding.

In the processing process, specifically, for example, a cutting tool is replaced or an angle is slightly corrected between the through holes 15A and 15B and between the through holes 16 and 17, whereby the machining equipment can be used in common. Thus, the communization of the machining equipment enables the reduction in the manufacturing cost.

Second Embodiment

Figure 5A:
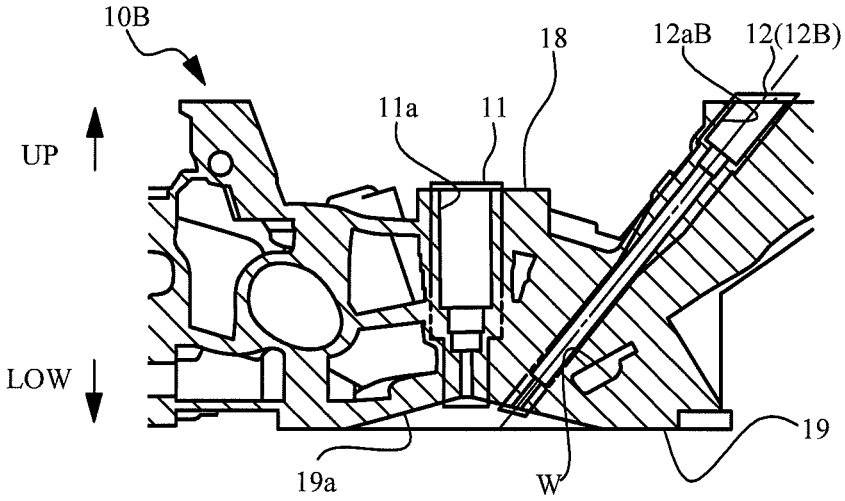
FIG. 5A is a sectional view of a preformed article for a first cylinder head in a second embodiment.
Figure 5B:
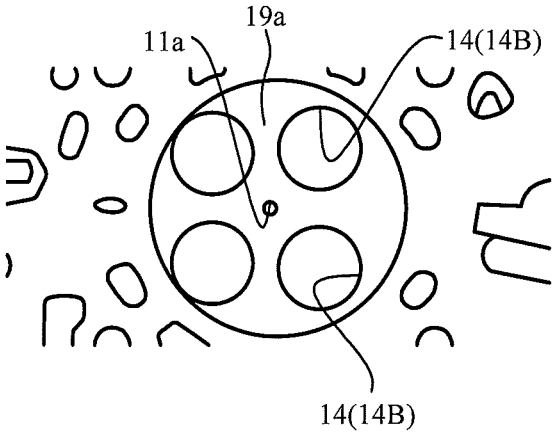
FIG. 5B is a bottom plan view of the preformed article for the cylinder head.

FIG. 5A and FIG. 5B are views of the preformed article 10B. FIG. 5A is a sectional view of the preformed article, and FIG. 5A is a bottom view of the preformed article 10B. The preformed article 10B is a first preformed article in the present embodiment and is the same as the preformed article 10A, except that the intake port 14 is specifically an intake port 14B different from the intake port 14A and that the portion 12 is specifically a portion 12B different from the portion 12A.

The intake port 14B is an independent intake port in which the plural intake ports (two in this case) are provided independently of each other in the central portion 19*a*. The specific shape of each intake port 14B may be different from each other. The two intake ports 14B are applicable to, for example, a helical port and a tangential port capable of forming a swirl flow.

The portion 12B is a second portion instead of the portion 12A and is the same as the portion 12A, except that the prepared hole portion 12*a*B is provided instead of the prepared hole portion 12*a*A and that the following will be described below. The prepared hole portion 12*a*B is a second prepared hole portion instead of the prepared hole portion 12*a*A and is the same as the prepared hole portion 12*a*A, except that the prepared hole portion is formed to the central portion 19*a* instead of the intake port 14.

Unlike the portion 12A, the portion 12B is where the intake port 14 is not formed. Therefore, the portion 12B is not formed such that the through hole 16 overlaps the intake port 14. Additionally, the portion 12B can be a portion where the intake port 14 is further formed in part, and the through hole 16 can be a through hole which is to be formed to at least partially overlap the intake port 14.

In the preformed article 10B, the prepared hole portion 11*a* is specifically a prepared hole portion where the through hole 15A is to be formed. In the preformed article 10B, the prepared hole portion 11*a* may not be always a through hole common to the through holes 15A and 15B. In other words, the specific shape of the prepared hole portion 11*a* in the preformed article 10B may differ from the shape of the prepared hole portion 11*a* in the preformed article 10A. In the preformed article 10B, the through hole 16 may not always open to the outer wall portion positioned above the intake port 14. That is, for example, the through hole 16 may open to the side wall portion, and each intake port 14B may open to the side wall portion so as to sandwich the through hole 16.

Figure 6A:
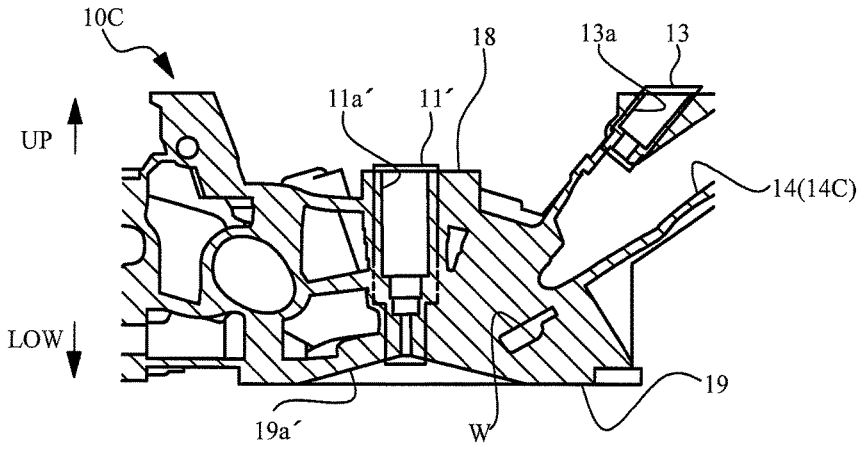
FIG. 6A is a sectional view of the preformed article for a second cylinder head in the second embodiment.
Figure 6B:
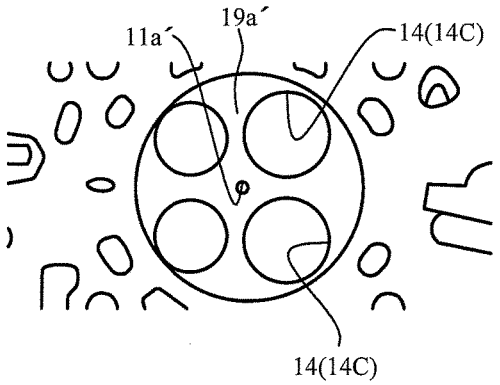
FIG. 6B is a bottom plan view of the preformed article for the cylinder head.

FIG. 6A and FIG. 6B are views of a preformed article 10C. FIG. 6A is a sectional view of the preformed article 10C, and FIG. 6B is a bottom view of the preformed article 10C. The preformed article 10C is a second preformed article in the present embodiment and is the same as the preformed article 10B, except that a portion 11' is provided instead of the portion 11, that a central portion 19*a*' is provided instead of the central portion 19*a*, that the intake port 14 is specifically an intake port 14C different from the intake port 14B, and that a portion 13 is provided instead of the portion 12.

The portion 11' is the same as the portion 11 in the preformed article 10B. The portion 11' is specifically a portion including a prepared hole portion 11*a*' which is the same as the prepared hole portion 11*a* in the preformed article 10B. The prepared hole portion 11*a*' is a through hole where the through hole 15B is to be formed. The central portion 19*a*' is the same central portion as the central portion 19*a* in the preformed article 10B. To be the same is described above. Thus, for example, the specific shape of the prepared hole portion 11*a*' may differ from the shape of the prepared hole portion 11*a* in the preformed article 10B.

The intake port 14C opens to the central portion 19*a*'. The intake port 14C is a siamese port which branches into plural portions (two in this case) on the way to a central portion 19' and which opens thereto. In the intake port 14C, the specific shape is not limited due to the intake port such as the intake port 14A common to the cylinder heads 1A and 2A. Therefore, an intake port having an inner diameter different from an opening portion, of the intake port 14A, opening to the central portion 19*a* is applied to an opening portion, of the intake port 14C, opening to the central portion 19*a*'. The intake port 14C may be the same as the intake port 14A.

The portion 13 is a portion where the through hole 17 described above is to be formed. The portion 13 is a portion where the intake port 14 is partially formed. Specifically, an end portion of the portion 13 is where the intake port 14 is partly formed. The portion 13 is specifically a portion including the prepared hole portion 13*a*. The prepared hole portion 13*a* is a third through hole, and the prepared hole portion 13*a* is where the through hole 17 is to be formed. The prepared hole portion 13*a* is a prepared hole portion formed from the above mentioned outer wall portion to the intake port 14. The prepared hole portion 13*a* may be the same as the prepared hole portion 12*a*A in shape. The portion 13 is a portion where the cooling water passage W is not formed.

The preformed article 10B is manufactured by partially changing the casting process for the preformed article 10C which is another preformed article. The part change specifically includes at least one (both in this case) of a first change and a second change to be described below.

The first change is a change to differ from the portion 13 (specifically, the prepared hole portion 13*a*) provided in the preformed article 10C. The first change is specifically a change from the portion 13 to the portion 12B (specifically, a change from the prepared hole portion 13*a* to the prepared hole portion 12*a*B). The second change is a change to differ from the intake port 14C provided in the preformed article 10C. The second change is specifically a change from the intake port 14C to the intake port 14B.

The portions 11, 11', 12B, and 13 (specifically, the prepared hole portions 11*a*, 11*a*', 12*a*B, and 13*a*) and the intake ports 14B and 14C are formed by a core in the casting process. Thus, the preformed article 10B is manufactured by replacing the core between the preformed articles 10B and 10C in the casting process. Therefore, the partial change to be performed between the preformed articles 10B and 10C in the casting process is more specifically a partial change by replacing the core.

On the other hand, the preformed article 10C is manufactured by partially changing the casting process between the preformed articles 10B and 10A. Accordingly, from the point of view of the preformed article 10C, the partial change includes at least one (both in this case) of the first change and the second change described below.

That is, the first change in this case is a change to differ from the portion 12B (specifically, the prepared hole portion 12*a*B) provided in the preformed article 10B. The first change in this case is specifically a change from the portion 12B into the portion 13 (specifically, a changes from the prepared hole portion 12*a*B to the prepared hole portion 13*a*). Further, the second change in this case is a change to differ from the intake port 14B provided in the preformed article 10B. The second change in this case is specifically a change from the intake ports 14B into the intake ports 14C.

The partial change which is performed between the preformed articles 10B and 10C in the casting process has only to be a change within a range where the present invention can have effects. Thus, the partial change may include, for example, a change in specific shape between the portions 11 and 11' (specifically, between the prepared hole portions 11*a* and 11*a*'), a change in the cooling water passage W, a change in the prepared hole portion where the through hole is to be formed to be acceptable to the fuel injection valve 43, and other changes.

Figure 7A:
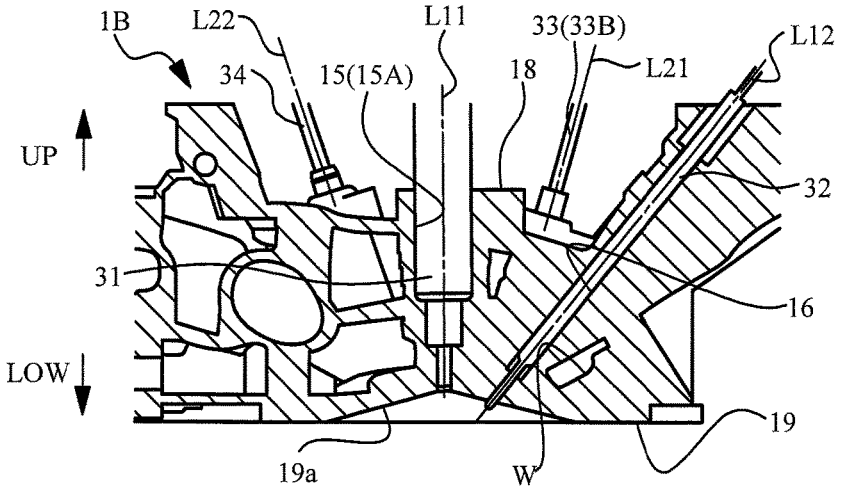
FIG. 7A is a sectional view of the first cylinder head in the second embodiment.
Figure 7B:
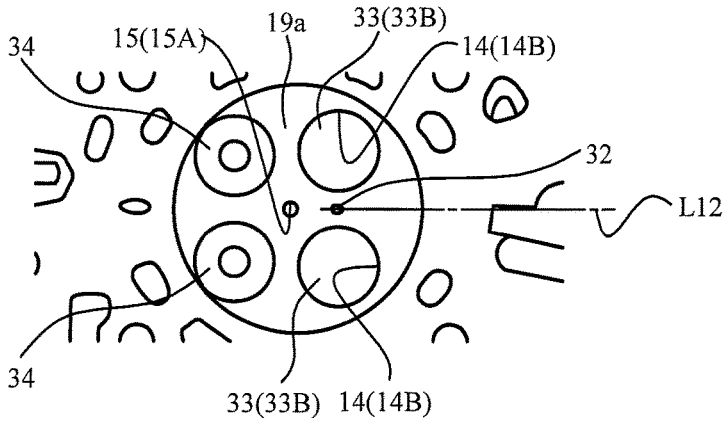
FIG. 7B is a bottom plan view of the cylinder head.

FIG. 7A and FIG. 7B are views of the cylinder head 1B. FIG. 7A is a sectional view of the cylinder head 1B, and FIG. 7B is a bottom view of the cylinder head 1B. FIG. 7A and FIG. 7B illustrate the cylinder head 1B in the state where the fuel injection valve 31, the glow plug 32, the intake valves 33, and the exhaust valve 34 are provided. The intake valve 33 is specifically an intake valve 33B corresponding to the intake port 14B. Additionally, the intake port 14 in the cylinder head 1B may be an intake port formed by processing the intake port 14 in a predetermined manner.

The cylinder head 1B is a first cylinder head in the present embodiment and is manufactured by using the preformed article 10B. The cylinder head 1B is a cylinder head for the compression ignition type internal combustion engine. The cylinder head 1B is the same as the cylinder head 1A, except that the intake port 14B is provided instead of the intake port 14A, and that the through hole 16 is not formed so as to overlap the intake port 14. The specific shape of the through hole 16 in the cylinder head 1B may differ from the shape of the through hole 16 in the cylinder head 1A due to the through hole 16 formed so as not to overlap the intake port 14 or due to the shape of the prepared hole portion 12*a*B.

Figure 8A:
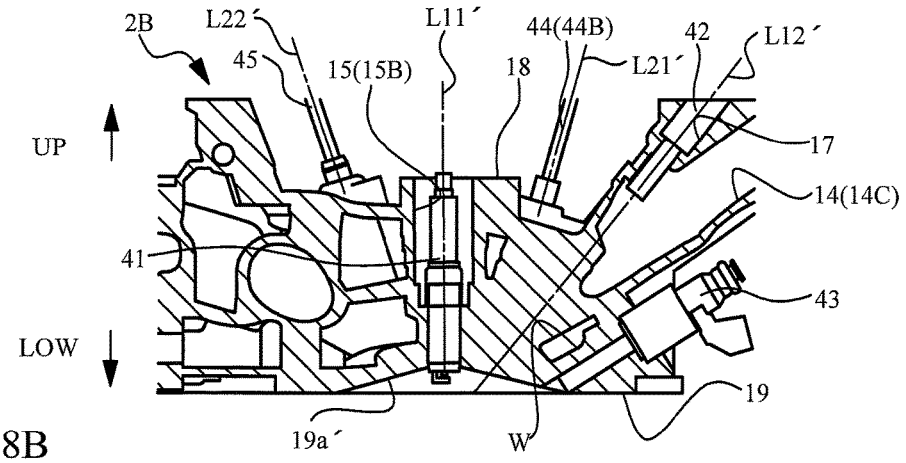
FIG. 8A is a sectional view of the second cylinder head in the second embodiment.
Figure 8B:
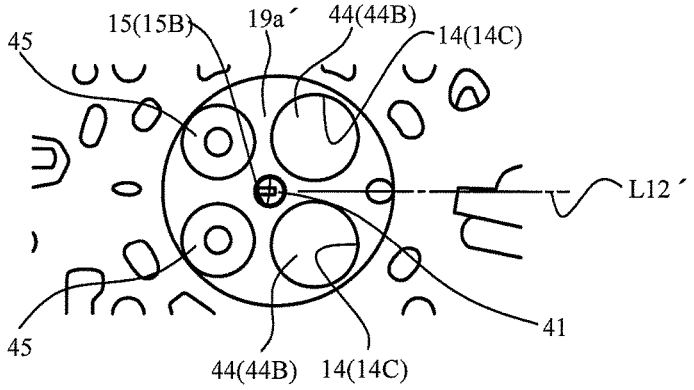
FIG. 8B is a bottom plan view of the cylinder head.

FIG. 8A and FIG. 8B are views of a cylinder head 2B. FIG. 8A is a sectional view of the cylinder head 2B, and FIG. 8B is a bottom view of the cylinder head 2B. FIG. 8A and FIG. 8B illustrate the cylinder head 2B in the state where the ignition plug 41, the fuel injection valve 42, the fuel injection valve 43, intake valves 44, and exhaust valves 45. The intake valve 44 is specifically an intake valve 44B corresponding to the intake ports 14C. The intake port 14 in the cylinder head 2B may be an intake port formed by processing the preformed article 10C in the intake port 14 in a predetermined manner.

The cylinder head 2B is a second cylinder head in the present embodiment and is manufactured by using the preformed article 10C. The cylinder head 2B is a cylinder head for the spark ignition type internal combustion engine and is specifically a cylinder head for the spark ignition type internal combustion engine having a turbocharger. The cylinder head 2B is the same as the cylinder head 2A, except that the intake port 14C is provided instead of the intake port 14A. The specific shape of the through hole 17 in the cylinder head 2B may differ from the shape of the through hole 17 in the cylinder head 2A due to the shape of the prepared hole portion 13*a*. The through hole 15B has the same arrangements.

As illustrated in FIG. 7A and FIG. 8A, axes L21 and L21' of respective insertion holes for the intake valves 33B and 44B arranged in the same manner in the cylinder heads 1B and 2B are the same as each other. Axes L22 and L22' of respective insertion holes for the exhaust valves 34 and 45 arranged in the same manner in the cylinder heads 1B and 2B are also the same as each other. An inner diameter of an opening portion opening to the central portion 19*a* in the intake port 14B is smaller than that of an opening portion opening to the central portion 19*a*' in the intake port 14C. Thus, a valve seat diameter of the intake valve 33B is smaller than that of the intake valve 44B.

On the other hand, the preformed articles 10B and 10C are configured in further consideration of the insertion holes for the intake valves 33B and 44B, the insertion holes for the exhaust valves 34 and 45, and the opening portions of the intake ports 14B and 14C.

Specific configurations of the preformed articles 10B and 10C further considering the insertion holes for the intake valves 33B and 44B are as follows. That is, the preformed article 10B further includes a portion where the insertion hole for the intake valve 33B is to be formed, the insertion hole is provided in the cylinder head 2B manufactured by using the preformed article 10C, and there is the provision of the axis L21 which is configured to be the same as the axis L21' of the insertion hole for the intake valve 44B arranged in the same manner as the intake valve 33B. Also, the preformed article 10C further includes a portion where the insertion hole for the intake valve 44B is to be formed, the insertion hole is provided in the cylinder head 1B manufactured by using the preformed article 10B, and there is the provision of the axis L21' which is configured to be the same as the axis L21 of the insertion hole for the intake valve 33B arranged in the same manner as the intake valve 44B.

Specific configurations of the preformed articles 10B and 10C further considering the insertion holes for the exhaust valves 34 and 45 are as follows. That is, the preformed article 10B further includes a portion where the insertion hole for the exhaust valve 34 is to be formed, the insertion hole is provided in the cylinder head 2B manufactured by using the preformed article 10C, and there is the provision of the axis L22 which is configured to be the same as the axis L22' of the insertion hole for the exhaust valve 45 arranged in the same manner as the exhaust valve 34. Also, the preformed article 10C further includes a portion where the insertion hole for the exhaust valve 45 is to be formed, the insertion hole is provided in the cylinder head 1B manufactured by using the preformed article 10B, and there is the provision of the axis L22' which is configured to be the same as the axis L22 of the insertion hole for the exhaust valve 34 arranged in the same manner as the exhaust valve 45.

Respective portions where the insertion holes for the intake valves 33B and 44B and the insertion holes for the exhaust valves 34 and 45 are to be formed can be portions including respective prepared hole portions where the insertion holes for the corresponding intake valves 33B and 44B and the exhaust valves 34 and 45 are to be formed. The portion can be a portion where the cooling water passage W is not formed. Each prepared hole portion can be specifically a prepared hole portion formed from the upper wall portion 18 to the intake port 14 or the exhaust port. Each prepared hole portion can be a portion where an insertion hole each for corresponding intake valves 33B and 44B and exhaust valves 34 and 45 is to be at least partially formed.

Specific configurations of the preformed articles 10B and 10C further considering the opening portions of the intake port 14B and 14C are as follows. That is, the preformed article 10B is configured to be provided with the opening portion which opens to the central portion 19*a* in the intake port 14B and which has the inner diameter smaller than that of the opening portion opening to the central portion 19*a'* in the intake port 14C provided in the preformed article 10C. Also, the preformed article 10C is configured to be provided with the opening portion which opens to the central portion 19*a'* in the intake port 14C and which has the inner diameter larger than that of the opening portion opening to the central portion 19*a* in the intake port 14B provided in the preformed article 10B.

The cylinder head 1B is manufactured through the process P21 which will be described later and which is a first step in the present embodiment. Further, the cylinder head 2B is manufactured through the process P22 which is a second step in the present embodiment described later. The process P21 is a process in which the through hole 15 is formed in the preformed article 10B to be acceptable to the fuel injection valve 31 (namely, the through hole 15A is formed) and the through hole 16 is formed to be acceptable to the glow plug 32. The process P22 is a process in which the through hole 15 is formed in the preformed article 10C to be acceptable to the ignition plug 41 (namely, the through hole 15B is formed) and the through hole 17 is formed to be acceptable to the fuel injection valve 42.

As described earlier, the preformed articles 10B and 10C are preformed articles manufactured by partially changing them. Thus, the cylinder heads 1B and 2B are manufactured by selectively performing the process P21 or P22 to the preformed article 10B or 10C. The manufacturing method for the cylinder head (hereinafter referred to as manufacturing method M2) which includes these processes P21 and P22 and which selectively performs the process P21 or P22 to the preformed article 10B or 10C is achieved, specifically, in the processing process common to the preformed articles 10B and 10C of the manufacturing process after the molding.

Next, main effects of the present embodiment will be described. The preformed article 10B is a configured to be manufactured by partially changing the casting process between the preformed articles 10B and 10C. Such a configured preformed article 10B can be obtained as a preformed article, for the compression ignition type internal combustion engine, suitable for the communization of the manufacturing process for the molded cylinder head.

The preformed article 10C is a configured to be manufactured by partially changing the casting process between the preformed articles 10B and 10C. Such a configured preformed article 10B can be obtained as a preformed article, for the spark ignition type internal combustion engine, suitable for the communization of the manufacturing process for the molded cylinder head.

The cylinder head 1B is manufactured by using the preformed article 10B. Therefore, the cylinder head 1B can reduce the manufacturing cost by the communization of the manufacturing process for the cylinder head between the compression ignition type internal combustion engine and the spark ignition type internal combustion engine. Further, in the cylinder head 1B, the through hole 15 is formed to be acceptable to the fuel injection valve 31, and the through hole 16 is formed to be acceptable to the glow plug 32. It is thus possible to obtain specifically a cylinder head for the compression ignition type internal combustion engine on the basis of the cylinder head 1A.

The cylinder head 2B is manufactured by using the preformed article 10C. Therefore, the cylinder head 2B can reduce the manufacturing cost by the communization of the manufacturing process for the cylinder head between the compression ignition type internal combustion engine and the spark ignition type internal combustion engine. Further, in the cylinder head 2B, the through hole 15 is formed to be acceptable to the ignition plug 41, and the through hole 17 is formed to be acceptable to the fuel injection valve 42. It is thus possible to obtain specifically a cylinder head for the spark ignition type internal combustion engine on the basis of the cylinder head 2B.

The cylinder heads 1B and 2B are specifically cylinder heads which can reduce the manufacturing cost by the communization of specifically, the processing process which is the manufacturing process for the molded cylinder head.

Additionally, like the cylinder head 1B, the preformed article 10B in which the through hole 15 is to be formed to be acceptable to the fuel injection valve 31 and in which the through hole 16 is to be formed to be acceptable to the glow plug 32 is a preformed article which enables the above mentioned effects. Likewise, like the cylinder head 2B, the preformed article 10C in which the through hole 15 is to be formed to be acceptable to the ignition plug 41 and in which the through hole 17 is to be formed to be acceptable to the fuel injection valve 42 is a preformed article which enables the above mentioned effects.

The cylinder head 1B is configured to have the axis L21, of the insertion hole for the intake valve 33B, the same as the axis L21' of the insertion hole for the intake valve 44B provided in the cylinder head 2B in the same manner as the intake valve 33B. Likewise, the cylinder head 2B is configured to have the axis L21', of the insertion hole for the intake valve 44B, the same as the axis L21 of the insertion hole for the intake valve 33B provided in the cylinder head 1B in the same manner as the intake valve 44B.

Thus, the cylinder heads 1B and 2B enables further enhancement of the commonality of the cylinder head between the compression ignition type internal combustion engine and the spark ignition type internal combustion engine. As a result, it is possible to further reduce the manufacturing cost by the communization of the processing process after the molding.

In this case, the cylinder heads 1B and 2B enable the common use of the machining equipment for, specifically, for example, the processing for a seat portion on which the intake valve 33B or 44B closes and abuts, the processing for a stem guide portion, and the hole processing for a lash adjuster. Further, the cylinder heads 1B and 2B facilitate the assembling of the intake valves 33B and 44B, for example, in the assembling process, thereby also reducing the manufacturing cost. In addition, the preformed articles 10B and 10C further considering the insertion holes for the intake valves 33B and 44B also have the same effects.

The cylinder head 1B is configured to have the axis L22, of the insertion hole for the exhaust valve 34, the same as the axis L22' of the insertion hole for the exhaust valve 45 provided in the cylinder head 2B in the same manner as the exhaust valve 34. Likewise, the cylinder head 2B is configured to have the axis L22', of the insertion hole for the exhaust valve 45, the same as the axis L22 of the insertion hole for the exhaust valve 34 provided in the cylinder head 1B in the same manner as the exhaust valve 45.

Thus, the cylinder heads 1B and 2B enables further enhancement of the commonality of the cylinder head between the compression ignition type internal combustion engine and the spark ignition type internal combustion engine. As a result, it is possible to further reduce the manufacturing cost by the communization of the processing process after the molding. In addition, the preformed articles 10B and 10C further considering the insertion holes for the exhaust valves 34 and 45 also have the same effects.

The cylinder head 1B is configured to be provided with the opening portion which opens to the central portion 19*a* in the intake port 14B and which has the inner diameter smaller than that of the opening portion opening to the central portion 19*a'* in the intake port 14C provided in the cylinder head 2B. Therefore, the cylinder head 1B can further ensure the installation space for the glow plug 32 in a preferable manner. In addition, the preformed article 10B further considering the openings of the intake port 14B and 14C also has the same effects.

The cylinder head 2B is configured to be provided with the opening portion which opens to the central portion 19*a'* in the intake port 14C and which has the inner diameter larger than that of the opening portion opening to the central portion 19*a* in the intake port 14B provided in the cylinder head 1B. Thus, the cylinder head 2B can also reduce the fuel consumption based on the improvement in output and the reduction in pumping loss in the internal combustion engine, as compared with the cylinder head 2A. In addition, the preformed article 10C further considering the openings of the intake port 14B and 14C also has the same effects.

The cylinder head 1B is configured specifically such that the central portion 19*a* has a pent roof shape. Therefore, like the cylinder head 1A, the cylinder head 1B can suppress generation of smoke in the high load in the compression ignition type internal combustion engine. Further, such a configured cylinder head 1B can further enhance the commonality of the cylinder head between the compression ignition type internal combustion engine and the spark ignition type internal combustion engine. The preformed article 10B in which the central portion 19*a* has a pent roof shape also has the same effects.

The manufacturing method M2 includes the processes P21 and P22 and selectively performs the process P21 or P22 to the preformed article 10B or 10C. Thus, the manufacturing method M2 can reduce the manufacturing cost by the communization of the manufacturing process for the cylinder head between the compression ignition type internal combustion engine and the spark ignition type internal combustion engine. The manufacturing method M2 can reduce the manufacturing cost, specifically, in the processing process after the molding.

While the exemplary embodiments of the present invention have been illustrated in detail, the present invention is not limited to the above-mentioned embodiments, and other embodiments, variations and modifications may be made without departing from the scope of the present invention.

For example, the intake port may open at one point in the central portion. Also, for example, the first portion and the second portion may be a material portions. The first portion and the second portion may be portions to which lightening its weight is at least partially applied. The central portion can also have, for example, a flat shape instead of a pent roof shape.

For example, the partial change which is performed between the preformed articles in the casting process has only to be a change in other portions than each prepared hole portion included in the second and third portions and than the intake port, as long as the present invention can have effects. Thus, as for the preformed articles manufactured by partially changing the casting process, each prepared hole portion included in the second and third portions may be common, and the intake port may be common, whereas the other portions are different.

DESCRIPTION OF LETTERS OR NUMERALS cylinder head 1A, 1B, 2A, 2B
preformed article 10A, 10B, 10C
portion (first portion) 11, 11'
portion (second portion) 12,12 A, 12B
portion (third portion) 13
intake port 14, 14A, 14B, 14C
upper wall portion 18
bottom wall portion 19
central portion 19*a*, 19*a'*
through hole (first through hole) 15, 15A, 15B through hole (second through hole) 16
through hole (third through hole) 17
fuel injection valve 31, 42, 43
glow plug 32
ignition plug 41

The invention claimed is:

1. A preformed article for a cylinder head, the preformed article comprising:

a first portion including a first prepared hole portion for forming a first through hole from an upper wall portion to a central portion which is a portion, of a bottom wall portion, forming a combustion chamber of an internal combustion engine; and a second portion including a second prepared hole portion common to a second through hole and a third through hole, the second prepared hole portion being for forming at least one of the second through hole and the third through hole, the second through hole being formed through a part of an intake port to the central portion from an outer wall portion positioned above the intake port which opens to the central portion, the third through hole being formed from the outer wall portion to the intake port, being not formed to the central portion, and having a same axis as an axis of the second through hole, the second portion including: the second prepared hole portion formed from the outer wall portion to the intake port and not formed to the central portion; and a portion positioned between the intake port and the central portion, intersecting with an axis of the second prepared hole portion, and not having a hole, the first prepared hole portion being formed to allow the first through hole to selectively accommodate a fuel injection valve of a compression ignition type internal combustion engine or an ignition plug of a spark ignition type internal combustion engine wherein the second prepared hole portion is formed before the second through hole, and the second prepared hole portion being formed to allow the third through hole to accommodate another fuel injection valve of the spark ignition type internal combustion engine different from said fuel injection valve and to allow the second through hole to accommodate a glow plug of the compression ignition type internal combustion engine wherein the second prepared hole portion is formed before the third through hole.

2. A method for manufacturing a cylinder head by using a preformed article for the cylinder head, the preformed article for the cylinder head including:

a first portion including a first prepared hole portion for forming a first through hole from an upper wall portion to a central portion which is a portion, of a bottom wall portion, forming a combustion chamber of an internal combustion engine; and a second portion including a second prepared hole portion common to a second through hole and a third through hole, the second prepared hole portion being for forming one of the second through hole and the third through hole, the second through hole being formed through a part of an intake port to the central portion from an outer wall portion positioned above the intake port which opens to the central portion, the third through hole being formed from the outer wall portion to the intake port, being not formed to the central portion, and having a same axis as an axis of the second through hole, the second portion including: the second prepared hole portion formed from the outer wall portion to the intake port and not formed to the central portion; and a portion positioned between the intake port and the central portion, intersecting with an axis of the second prepared hole portion, and not having a hole, the method comprising:

a first step of forming, in the preformed article for the cylinder head, a first through hole to be acceptable to a fuel injection valve of a compression ignition type internal combustion engine by using the first prepared hole portion, and a second through hole to be acceptable to a glow plug of the compression ignition type internal combustion engine by using the second prepared hole portion, wherein the second prepared hole portion is formed before the second through hole; and a second step of forming, in the preformed article for the cylinder head, the first through hole to be acceptable to an ignition plug of a spark ignition type internal combustion engine by using the first prepared hole portion, and the third through hole to be acceptable to another fuel injection valve of the spark ignition type internal combustion engine different from the fuel injection valve by using the second prepared hole portion, wherein the second prepared hole portion is formed before the third through hole, wherein the first step and the second step are selectively performed.

* * * * *